US005742269A

United States Patent [19]

Hayashiguchi et al.

[11] Patent Number: 5,742,269

[45] Date of Patent: Apr. 21, 1998

[54] LCD CONTROLLER, LCD APPARATUS, INFORMATION PROCESSING APPARATUS AND METHOD OF OPERATING SAME

[75] Inventors: Fumiei Hayashiguchi, Kamakura; Takayuki Tokuda, Fujisawa, both of Japan

[73] Assignee: International Business Machines Corporation, Armonk, N.Y.

[21] Appl. No.: 826,575

[22] Filed: Jan. 27, 1992

[30] Foreign Application Priority Data

Jan. 25, 1991 [JP] Japan ..... 3-023720

[51] Int. Cl.[6] ..... G09G 3/36

[52] U.S. Cl. ..... 345/87; 345/94; 359/54

[58] Field of Search ..... 340/784, 805, 340/793, 814; 359/54, 85; 345/87, 94

[56] References Cited

U.S. PATENT DOCUMENTS

| | | | |
|---|---|---|---|
| 4,630,122 | 12/1986 | Morokawa | 340/784 |
| 4,816,816 | 3/1989 | Usui | 340/784 |
| 5,091,723 | 2/1992 | Kanno et al. | 340/784 |

*Primary Examiner*—Ulysses Weldon
*Assistant Examiner*—Matthew Luo
*Attorney, Agent, or Firm*—David Aker; Ronald L. Drumheller

[57] ABSTRACT

A method and apparatus for removing the effect of data voltages for the last display line of a liquid crystal display (LCD) on the first line of the display. Prior to a horizontal line period, immediately before a data signal for the last display line is transferred to a driver, and a scanning electrode for the first display line of the following frame is turned on, signal electrodes are precharged with a voltage corresponding to data for the first display line of the following frame.

10 Claims, 4 Drawing Sheets

LCD CONTROLLER, LCD APPARATUS, INFORMATION PROCESSING APPARATUS AND METHOD OF OPERATING SAME

TECHNICAL FIELD

The present invention relates to liquid crystal display (LCD) apparatus. More particularly, it relates to a method for driving an LCD panel, and an LCD panel driven in accordance with the method.

BACKGROUND ART

FIG. 1(*a*) to FIG. 1(*c*) illustrate display control signals and display data in a conventional LCD apparatus. A frame pulse FP (FIG. 1(*a*)) and a latch pulse (FIG. 1(*b*)) correspond, respectively, to a vertical synchronizing signal and a horizontal synchronizing signal of a display controller. A shift clock pulse SCP (FIG. 1(*c*)) is a clock signal for data transfer. Data stored in a data shift register, to be applied to signal electrodes, shifts each time the shift clock pulse SCP is provided to the data shift register. Each time the latch pulse LP is provided to the data shift register, data is transferred from the data shift register in parallel to a driver output stage from which it is applied to the signal electrodes. Thus, each signal driver output stage provides an output voltage which corresponds to the data to be applied to a signal electrode.

Latch pulse LP is provided at the same time that it is provided to the data shift register (for the signal electrodes) to a scanning shift register which provides outputs to the scanning electrodes. Each time latch pulse LP is provided to the scanning shift register, the frame pulse FP is shifted as data within the scanning shift register. Thus the scanning electrodes are sequentially turned on in response to tile latch pulse LP being provided to the scanning shift register. The scanning electrodes are turned on one after another, but in synchronism with the output of data signals to the signal electrodes.

A vertical blanking period is established between frames. Frame pulse FP is not generated immediately after a voltage is applied to the scanning electrode for the last line of the display, and the scanning electrode for the last display line has been turned on, but is instead generated after a delay time corresponding to the blanking period. That is, the scanning electrode for the last display line is turned on and then, after a predetermined interval has elapsed, a scanning electrode for the first display line of the following frame is turned on. However, in such conventional LCD apparatus, it became clear that in some cases, data for the last display line produced an effect which appeared in the first display line. The present inventors determined the cause of such phenomena. That is, in a conventional LCD apparatus, even during a vertical blanking period after the last display line has been displayed, the application of a voltage according to data for the last display line to a signal electrode continues. However, because no scanning electrode is turned on during the vertical blanking period, no display line is in a display state, regardless of the voltage on the signal electrode. Thus, a voltage corresponding to data for the last display line is applied to each signal electrode for a relatively long period of time and then a voltage corresponding to data for the first display line of the following frame is applied to the signal electrode. The voltage applied to the signal electrode does not immediately change to follow the data.

In an LCD using a split driving method, i.e. one constructed so that the upper half and the lower half areas of one LCD panel are driven by different columns of signal electrodes, and the first display line of the lower display area is at the middle of the LCD panel, the same phenomenon appears. In particular, if a pattern is to be displayed in which only one horizontal line is displayed at the bottom of the lower display area and no lines are displayed in other areas, the horizontal line appears in the middle of the screen, that is, in the first display line of the lower screen. An example of this occurs in an LCD apparatus in multiple display modes, in which the number of display lines varies. If an image to be displayed includes a number of display lines which is smaller than the maximum number of display lines which can be displayed, the LCD controller is generally configured to blank out margins at the top and the bottom of the screen so as to center the image. A fixed voltage is applied to these unused lines at either an on level or an off level. In this case, a horizontal line having the wrong data may appear in the middle of the screen (i.e. the first line on the lower screen will be affected b the fixed voltage data of the last line of the display).

A driver for the signal electrodes of the lower screen is arranged to connect to respective columns of the signal electrodes. The display lines are usually driven sequentially from the top to the bottom of the screen. Therefore, the first display line of the lower screen is arranged at the longest distance from a driver output stage. This causes an increased impedance to exist between the driver output stage and the first display line for the signal electrodes and it becomes difficult for a voltage corresponding to the first display line to change rapidly. Also, the phenomenon discussed above is likely to occur.

SUMMARY OF THE INVENTION

It is an object of the present invention to remove the effect of data for the last display line on the first display line.

In accordance with the invention, a method for operating a liquid crystal display controller is provided. In a display controller having outputs for applying signals to data lines and scanning lines of a liquid crystal display, the improvement comprises applying voltages representative of data of a first line of an image to said data lines early enough in a period between display of a last line of a first frame of the image and display of a first line of a succeeding frame of the image, so as to charge said data lines to said voltages before the period has ended. More specifically, the voltages representative of data of the first line of the image are applied to the data line periods at least two horizontal lines before an end of the period. The period is the vertical blanking period of the display, during which none of the scanning electrodes are activated by the controller.

In accordance with the invention, a controller for a liquid crystal display having a plurality of signal electrodes and a plurality of scanning electrodes, and data voltage applying means for applying voltage representative of data for a line of an image to be displayed to the signal electrodes, includes the improvement of a transfer control means for controlling transfer of data to the data voltage applying means so that data for the first line of the image is transferred early enough in a period between display of a last line of a first frame of the image, and display of a first line of a subsequent frame of the image, to charge the data lines to voltages corresponding to the first line of the image, before the period has ended.

The period is the vertical blanking period, during which none of the scanning electrodes are activated by the controller.

The controller further comprises a first data output for supplying data for an upper portion of the liquid crystal display and a second data output for supplying data for a lower portion of the liquid crystal display.

DETAILED DESCRIPTION OF THE PREFERRED EMBODIMENT

Figure 2:
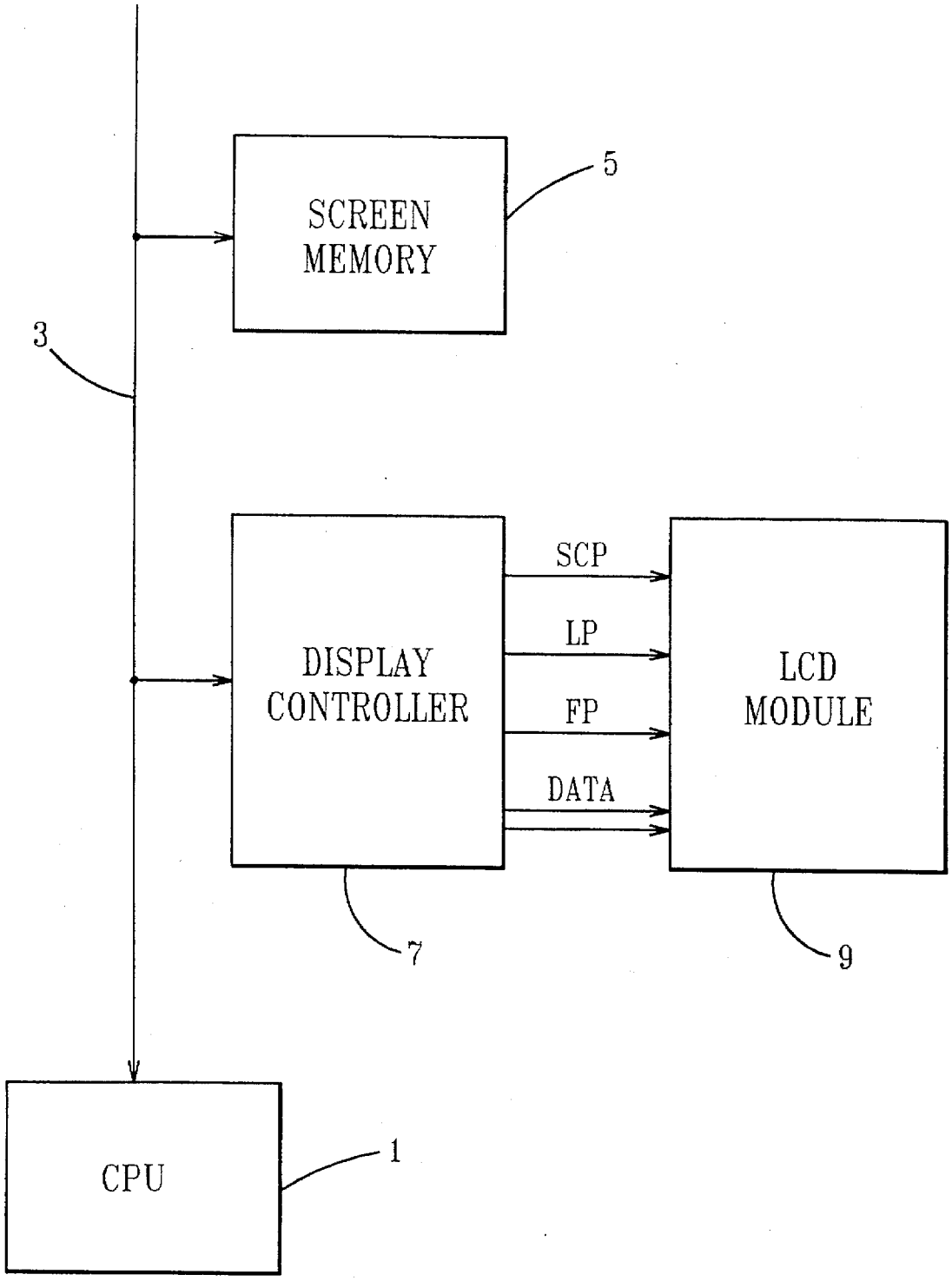
FIG. 2 is a block diagram illustrating an embodiment of an information processing apparatus constructed in accordance with the present invention.

FIG. 2 illustrates an embodiment of an information processing apparatus in accordance with the present invention. A CPU 1 has a bus 3 associated with it, to which are connected a screen memory 5 and a display controller 7. An LCD module 9 is connected to display controller 7. Screen memory 5 stores picture image data to be displayed by an LCD cell 10 (FIG. 3) of LCD module 9. Picture image data is periodically rewritten by the CPU 1. Display controller 7 transfers the picture image data stored in screen memory 5 and the required signals for display control shown in FIG. 4 to LCD module 9.

Figure 3:
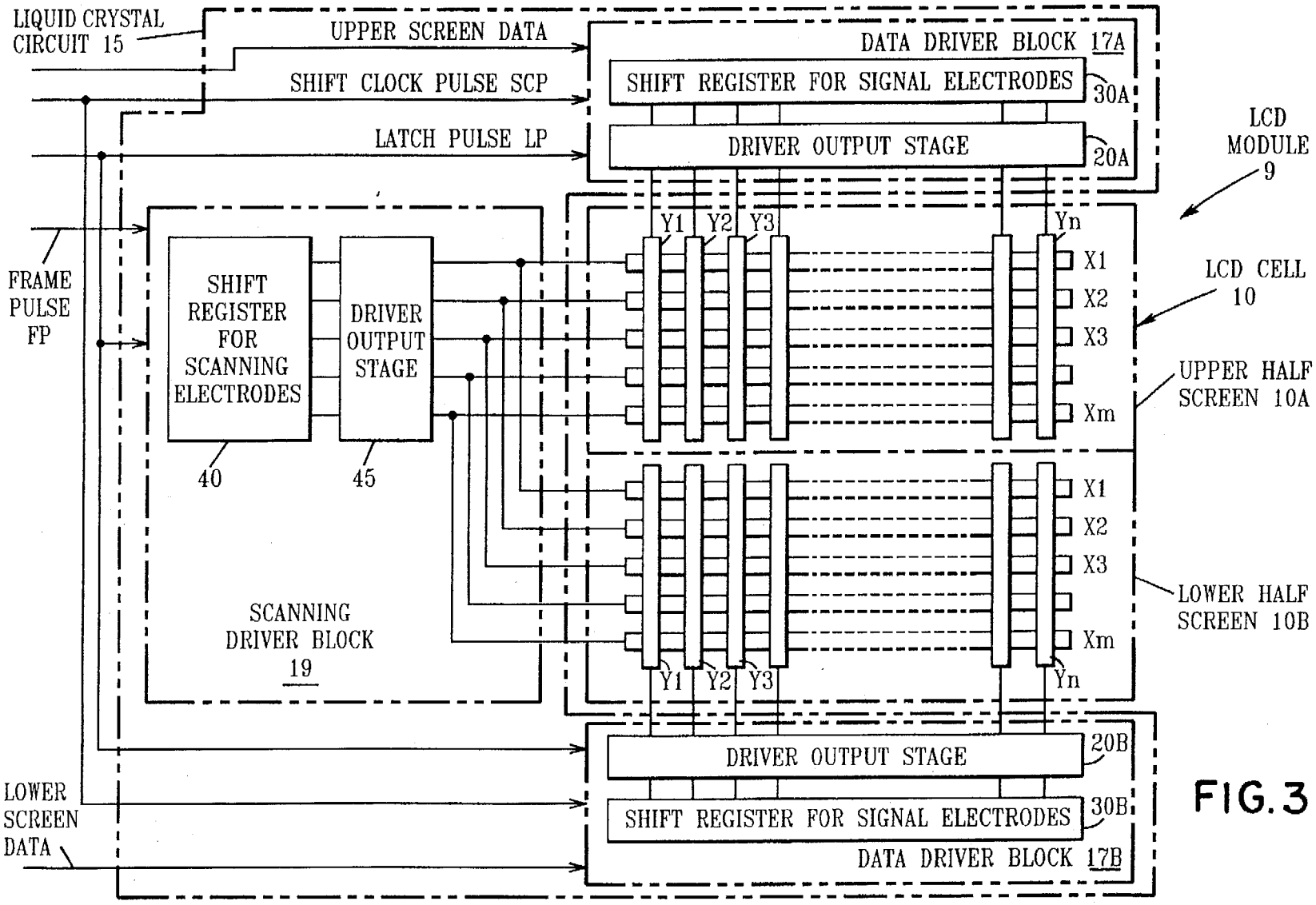
FIG. 3 is a block diagram illustrating an embodiment of an LCD apparatus constructed in accordance with the present invention.

As shown in FIG. 3, LCD module 9 comprises a matrix type LCD cell 10 and a liquid crystal driver 5. LCD cell 10, driven by a split driving method, includes columns of signal electrodes (also called data electrodes or segment electrodes) Y1, Y2, Y3 . . . Yn and rows of scanning electrodes (also called common electrodes) X1, X2, X3, . . . Xm for an upper half screen 10A and a lower half screen 10B. Liquid crystal driver 15 includes data driver blocks 17A and 17B and a scanning driver block 19. The data driver blocks 17A and 17B include driver output stages 20A and 20B and data shift registers 30A and 30B for the signal electrodes, respectively. The scanning driver block 19 includes a scanning shift register 40 and a driver output stage 45.

Each of the columns of signal electrodes Y1, Y2, Y3, . . . Yn for the upper half screen and the lower half screen is connected to respective driver output stage 20A or 20B. Driver output stages 20A or 20B are connected to data shift registers 30A and 30B, respectively. The respective scanning electrodes X1, X2, X3, . . . Xm for the upper and lower screens 10A and 10B are controlled by outputs of scanning shift register 40.

Figures 4A, 4B, 4C:
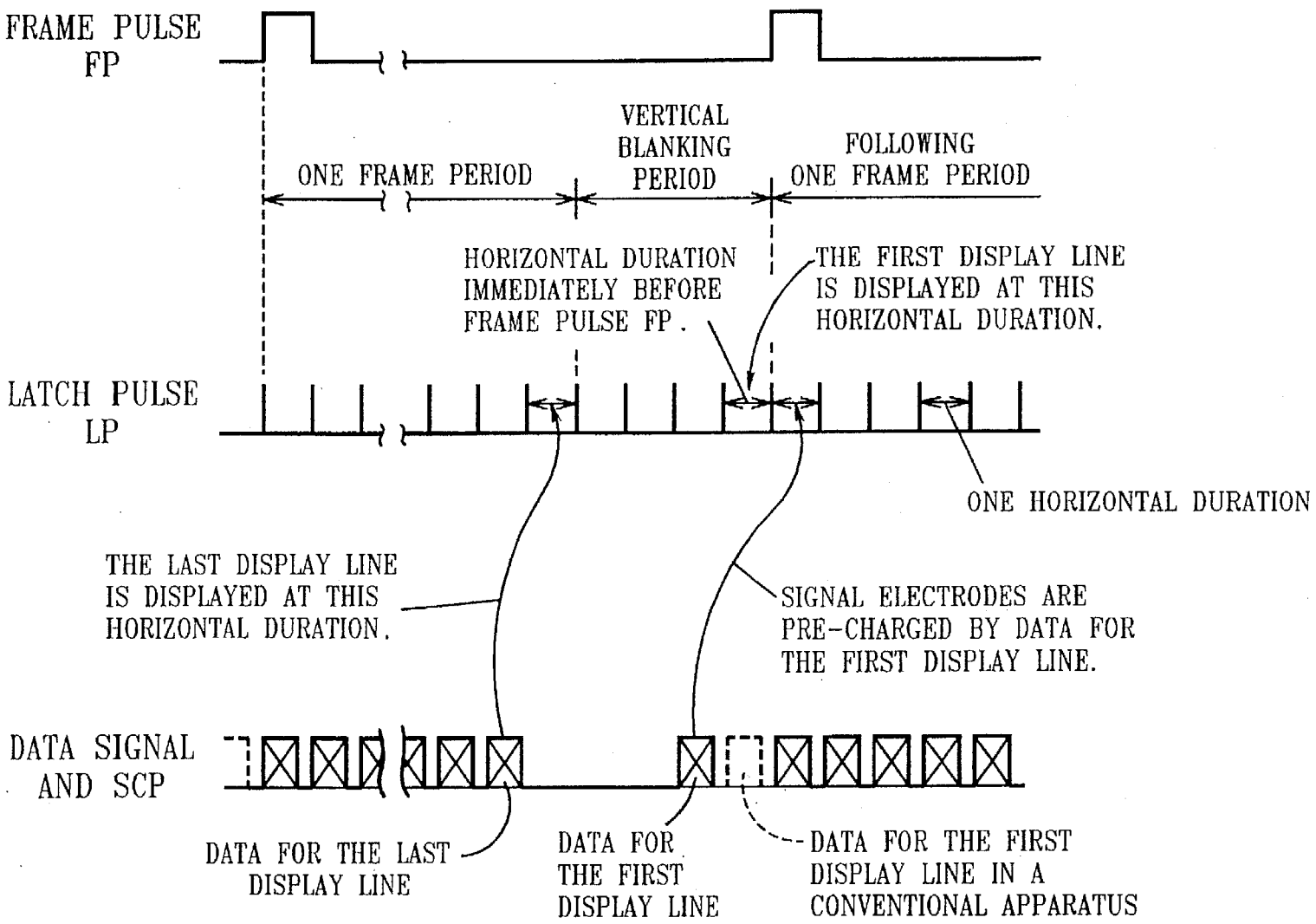
FIG. 4(*a*) to FIG. 4(*c*) illustrate waveforms of control signals in an embodiment of an LCD controller in accordance with the present invention.

Operation of the embodiment of the invention is described with reference to FIG. 2, FIG. 3 and FIG. 4.

Display controller 7 divides data signals for display into two groups (one for the upper screen and one for the lower screen) and transfers the data to the liquid crystal driver 15. Data signals for the upper screen and data signals for the lower screen are synchronized with shift clock pulses SCP and are shifted into the data shift registers 30A and 30B of the upper and the lower screens 10A and 10B, respectively.

After the completion of the shift of data corresponding to all signal electrodes Y1, Y2, Y3, . . . Yn for one display line into data shift registers 30A and 30B, the data is transferred to driver output stages 20A and 20B by means of a latch pulse LP. Driver output stages 20A and 20B are synchronized by the latch pulse LP, and simultaneously provide at their outputs voltage corresponding to the data for one display line for all signal electrodes Y1, Y2, Y3, . . . Yn.

The latch pulse LP is supplied simultaneously to driver output stages 20A and 20B, and as a clock input to the scanning shift register 40. A frame pulse FP is supplied to a data input line of scanning shift register 40 and shifted within shift register 40 each time a latch pulse LP is received. Thus, upon the occurrence of a first latch pulse LP, after the start of a frame pulse FP, a first scanning electrode X1 (the scanning electrode for the first display line) is turned on by driver output stage 45. Upon the occurrence of a second latch pulse LP, a second scanning electrode X2 is turned on, and finally the last scanning electrode Xm is turned on in the same manner. That is, the scanning electrodes X1, X2, X3, . . . Xm are sequentially turned on synchronously with latch pulses LP. In other words, each time data for one display line is sequentially transferred to one of the signal electrodes Y1 to Yn by means of a latch pulse LP provided to the clock inputs of data shift registers 30A and 30B, the respective scanning electrodes X1, X2, X3, . . . Xm of the upper and the lower screens 10A and 10B are sequentially turned on by means of latch pulses LP provided to the clock input of scanning shift register 40.

Reference is now made principally to lower screen 10B, but unless otherwise stated, the same description applies to upper screen 10A.

At the completion of the transfer of data for the last display line (scanning electrode Xm) to shift register 30B by shift latch pulse LP, a voltage corresponding to the data for the last display line is applied to the signal electrodes Y1 to Yn by driver output stage 20B, and the scanning electrode Xm is turned on. As a result, the last display line is displayed. Also, after the last display line has been displayed, latch pulses LP are received from display controller 7, one after another, at predetermined time intervals corresponding to the time of a horizontal line. However, as noted above, the following frame pulse FP is not transmitted from the display controller 7 immediately after the last display line has been displayed. Accordingly, until the following frame pulse FP is provided to the scanning electrode X1 (for the first display line), no scanning electrodes are turned on by means of latch pulse LP. This period of time for which no scanning electrodes are turned on is the vertical blanking period referred to above.

Figures 1A, 1B, 1C:
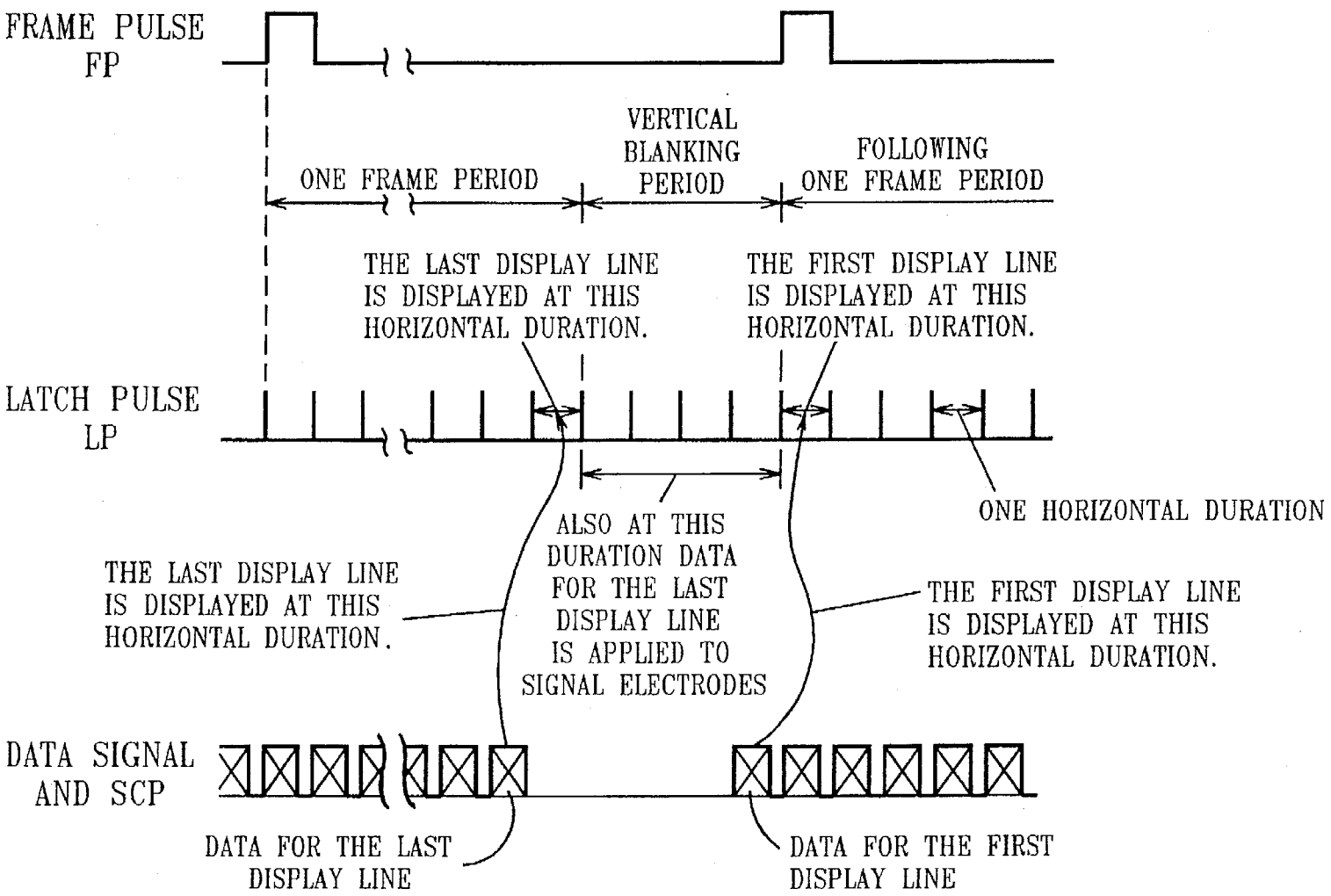
FIG. 1(*a*) to FIG. 1(*c*) illustrate waveforms of control signals in a conventional LCD controller.

In conventional liquid crystal display apparatus, data for the first display line of a frame is transferred to the data shift register during the horizontal scan time (or horizontal line period) immediately preceding frame pulse FP, and provided to the signal electrodes at the next horizontal line period. However, in accordance with the invention, horizontal data for the first display line of the following frame is transferred to the data driver block 17B (or, more specifically to the data shift register 30B) at an earlier time. In particular, data is transferred at least one horizontal line time (or horizontal line period) earlier than in a conventional LCD. In this regard, reference is made to FIG. 4(*b*) and FIG. 4(*c*) (which illustrate the present invention), which should be compared to FIG. 1(*b*) and FIG. 1(*c*) (which are conventional).

In the preferred embodiment, data is transferred precisely one horizontal scan period earlier than in a conventional LCD. At the horizontal line period, the data is supplied to the signal electrodes Y1 to Yn. The data voltages transferred to data shift register 30B are supplied, as a result of the application of a first latch pulse LP after the completion of the transfer of the data, to signal electrodes Y1 to Yn by the driver output stage 20B, and precharge these electrodes. At this point, none of scanning electrodes X1 to Xm are turned on, and thus a vertical blanking period continues.

Immediately before the completion of the horizontal line period during which the signal electrodes Y1 to Yn are precharged with a voltage corresponding to the data for the first display line, frame pulse FP of the following frame is transmitted to the scanning shift register 40, from the display controller 7. The first latch pulse LP, after a rise of the frame pulse FP, turns on the first scanning electrode X1 to display the first display line. Then voltages corresponding to data for the second display line (scanning electrode X2) previously transferred to data shift register 30B are provided at the following latch pulse LP, to the signal electrodes Y1 to Yn to display the second display line. The remaining display lines are sequentially displayed in the same manner.

In accordance with the embodiment of the invention described herein, the period of time for which data signals for the first display line are provided to the signal electrodes corresponds to two horizontal line periods of a conventional LCD. However, for subsequent lines, the data is provided for only one horizontal line period, as is conventional in the art. In accordance with the invention, before the first scanning electrode X1 is turned on and the first display line is displayed, the signal electrodes Y1 to Yn are given sufficient time for the voltage thereon to change in response to new data, and thus data for the last display line does not cause an error in display voltage (and therefore an error in the image) to occur on the first display line.

In the embodiment described herein, during a horizontal line period which is followed by a horizontal line period immediately before a frame pulse FP, data for the first display line is transferred to data shift register 30B. However, it will be appreciated that during the horizontal line period immediately before frame pulse FP, the data for the first display line may be again transferred to data shift register 30B. If the data for the first display line is transferred to data shift register 30B during the horizontal line period followed by the horizontal line period immediately before frame pulse FP, a voltage corresponding to the data for the first display line will be applied to the signal electrodes Y1 to Yn for two horizontal line periods, whether or not the data for the first display line is again transferred to data shift register 30B at a horizontal line period immediately before the following frame pulse FP.

It will be understood that data for the first display line may be transferred, to data shift register 30B, at an earlier time in the vertical blanking period. For example, it will be understood that during a horizontal line period immediately after data for the first display line of a frame has been transferred to the data shift register 30B, data for the first display line of the following frame may be transferred to data shift register 30B, for application to the signal electrodes Y1 to Yn during the vertical blanking period.

A circuit for the implementation of the present invention may readily be designed by one skilled in the art. For example, appropriate pulses for applying data at least one horizontal line duration earlier than in conventional displays, may be generated by a circuit, within display controller 7, that may include a horizontal line counter, and a few gates. Further, other circuits which perform the same function can be used. As it is also well known to those skilled in the art, a software implementation by suitable programming of CPU 1 may also be possible.

While this invention has been described in connection with a specific embodiment, it will be understood that those with skill in the art may be able to develop variations of the disclosed embodiment without departing from the spirit of the invention or the scope of the following claims:

What is claimed is:

1. In a controller for a liquid crystal display for displaying data from an image data source, said liquid crystal display having a plurality of signal electrodes and a plurality of scanning electrodes, said controller having data voltage applying means for applying a voltage representative of data for successive lines of an image, from said image data source, to be displayed by said liquid crystal display, the improvement comprising:

control means for controlling transfer of data from said image data source to said data voltage applying means so that data for a first line of said image is transferred early enough in a blanking period between display of a last line of a first frame of said image and display of a first line of a next frame of said image, to charge said data lines to said voltages representative of data for said first line of said image, before the blanking period has ended, said blanking period being a period during which none of said scanning electrodes are activated.

2. The controller of claim 1 wherein said transfer control means controls the of data to occur at least two horizontal line periods before an end of said blanking period.

3. The controller of claim 1 further comprising a first data output for supplying data for an upper portion of the liquid crystal display and a second data output for supplying data for a lower portion of the liquid crystal display.

4. The controller of claim 1 wherein said blanking period is a vertical blanking period.

5. The controller of claim 1 in combination with a liquid crystal display operatively connected to said controller.

6. The controller of claim 1 in combination with a data processing system including a liquid crystal display operatively connected to said controller.

7. In an information processing apparatus having a liquid crystal display module having matrix-type liquid crystal display cells, said liquid crystal display module having columns of signal electrodes and rows of scanning electrodes, drivers for driving said signal electrodes and said scanning electrodes, a video memory for storing data to be displayed on said liquid crystal display cells, a central processing unit for writing data to said video memory, and a liquid crystal display controller for transferring the data in said video memory and control signals to the drivers of said liquid crystal display module, the improvement comprising:

means in said liquid crystal display controller active in a blanking period between first and second successively displayed frames, during which none of said scanning electrodes are activated, for transferring from said video memory to said liquid crystal display module a first line of said second frame for charging said signal electrodes with voltages representative of said first line before said blanking period has ended.

8. In a method for operating a liquid crystal display having signal electrodes and scanning electrodes for displaying an image having successive frames, each frame having successive lines, and a blanking period of time spacing display of a last line of a first frame and a first line of a successive second frame, none of said scanning electrodes being activated during said blanking period, the method including the steps of shifting data for a line into a shift register, and applying voltages representative of the data in said shift register to said signal electrodes, the improvement comprising:

applying voltages representative of data of said first line of said second frame to said signal electrodes at a time in said blanking period early enough so that when said blanking period has ended said signal electrodes have been charged to said voltages representative of said data of said first line.

9. The method of claim 8 wherein data is supplied separately to an upper portion of said liquid crystal display and a lower portion of said liquid crystal display.

10. The method of claim 8 wherein said blanking period is a vertical blanking period.

* * * * *